US011359489B2

(12) United States Patent
House, Jr. et al.

(10) Patent No.: US 11,359,489 B2
(45) Date of Patent: Jun. 14, 2022

(54) FORMATION TESTER TOOL HAVING AN EXTENDABLE PROBE AND A SEALING PAD WITH A MOVABLE SHIELD

(71) Applicant: Halliburton Energy Services, Inc., Houston, TX (US)

(72) Inventors: Jerry Wade House, Jr., Conroe, TX (US); Yu-Hsing Charles Kuo, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/754,012

(22) PCT Filed: Dec. 22, 2017

(86) PCT No.: PCT/US2017/068108
§ 371 (c)(1),
(2) Date: Apr. 6, 2020

(87) PCT Pub. No.: WO2019/125481
PCT Pub. Date: Jun. 27, 2019

(65) Prior Publication Data

US 2020/0263539 A1 Aug. 20, 2020

(51) Int. Cl.
*E21B 49/10* (2006.01)
*E21B 49/08* (2006.01)

(52) U.S. Cl.
CPC ..... *E21B 49/10* (2013.01); *E21B 49/088* (2013.01)

(58) Field of Classification Search
CPC .. E21B 49/087; E21B 49/0875; E21B 49/088; E21B 49/10
See application file for complete search history.

(56) References Cited

U.S. PATENT DOCUMENTS 6,339,886 B1 * 1/2002 Reinhardt ..... E21B 47/08 33/302
7,114,562 B2 * 10/2006 Fisseler ..... E21B 17/1078 166/250.02

(Continued)

FOREIGN PATENT DOCUMENTS

EP 2754853 A1 7/2014

OTHER PUBLICATIONS

PCT Application No. PCT/US2017/068108, International Search Report, dated Sep. 20, 2018, 3 pages.

(Continued)

*Primary Examiner* — Jennifer H Gay
(74) *Attorney, Agent, or Firm* — DeLizio, Peacock, Lewin & Guerra

(57) ABSTRACT

A formation tester tool includes an extendable probe having an extendable member configured to extend from a retracted position to an extended position such that an end of the extendable probe is in fluid communication with a wall of a borehole during an operation to capture a fluid from a formation. The formation tester tool also includes a sealing pad positioned circumferentially around the extendable probe, wherein a face of the sealing pad is configured to sealingly engage the wall of the borehole while the extendable member is in the extended position. The formation tester tool also includes a shield to cover the sealing pad in a covered position between the sealing pad and the wall of the borehole.

18 Claims, 11 Drawing Sheets

(56) References Cited

U.S. PATENT DOCUMENTS

| | | | | |
|---|---|---|---|---|
| 7,311,142 | B2 * | 12/2007 | Fisseler | E21B 17/1078 166/100 |
| 7,581,440 | B2 | 9/2009 | Meek et al. | |
| 7,836,951 | B2 | 11/2010 | Georgi et al. | |
| 8,106,659 | B2 | 1/2012 | McGregor | |
| 8,806,932 | B2 | 8/2014 | Roessler | |
| 9,200,503 | B2 | 12/2015 | Irani et al. | |
| 9,534,481 | B2 | 1/2017 | Ayan et al. | |
| 9,732,611 | B2 * | 8/2017 | Zhang | E21B 49/005 |
| 2003/0098156 | A1 | 5/2003 | Follini et al. | |
| 2005/0109538 | A1 | 5/2005 | Fisseler | |
| 2007/0039730 | A1 * | 2/2007 | Fisseler | E21B 17/1078 166/254.2 |
| 2015/0027216 | A1 | 1/2015 | Zhang | |
| 2015/0053399 | A1 * | 2/2015 | Irani | E21B 49/081 166/264 |
| 2016/0273292 | A1 | 9/2016 | Morgan et al. | |
| 2020/0263539 | A1 * | 8/2020 | House, Jr. | E21B 49/10 |

OTHER PUBLICATIONS

PCT Application No. PCT/US2017/068108, Written Opinion, dated Sep. 20, 2018, 9 pages.

Thorat, et al., "Formation Pressure Testing While Drilling in Horizontal Wells—A Critical Link To Full Data Evaluation and Cost-Efficient Wellbore Construction", Society of Petrophysicists and Well Log Analysts (SPWLA), 1st Regional Conference, India, Mar. 2007, 8 pages.

* cited by examiner

FORMATION TESTER TOOL HAVING AN EXTENDABLE PROBE AND A SEALING PAD WITH A MOVABLE SHIELD

BACKGROUND

The disclosure generally relates to the field of well logging operations, and more particularly to well logging operations that include a formation tester tool.

Formation testing can provide important information for assessing and producing hydrocarbons from a well. Formation testing can occur while the well is being drilled or after the well is drilled. Well tools can be formation tester tools that include components used for formation testing operations such as monitoring formation pressures along well boreholes, capturing formation fluid samples, and predicting reservoir performance. Some formation tester tools include an elastomeric sealing pad that is pressed against a surface of the well to collect formation fluid samples for the sensors at the surface of a probe or fluid-receiving chambers placed in the tool.

BRIEF DESCRIPTION OF THE DRAWINGS

Embodiments of the disclosure can be better understood by referencing the accompanying drawings.

DESCRIPTION OF EMBODIMENTS

Figure 1:
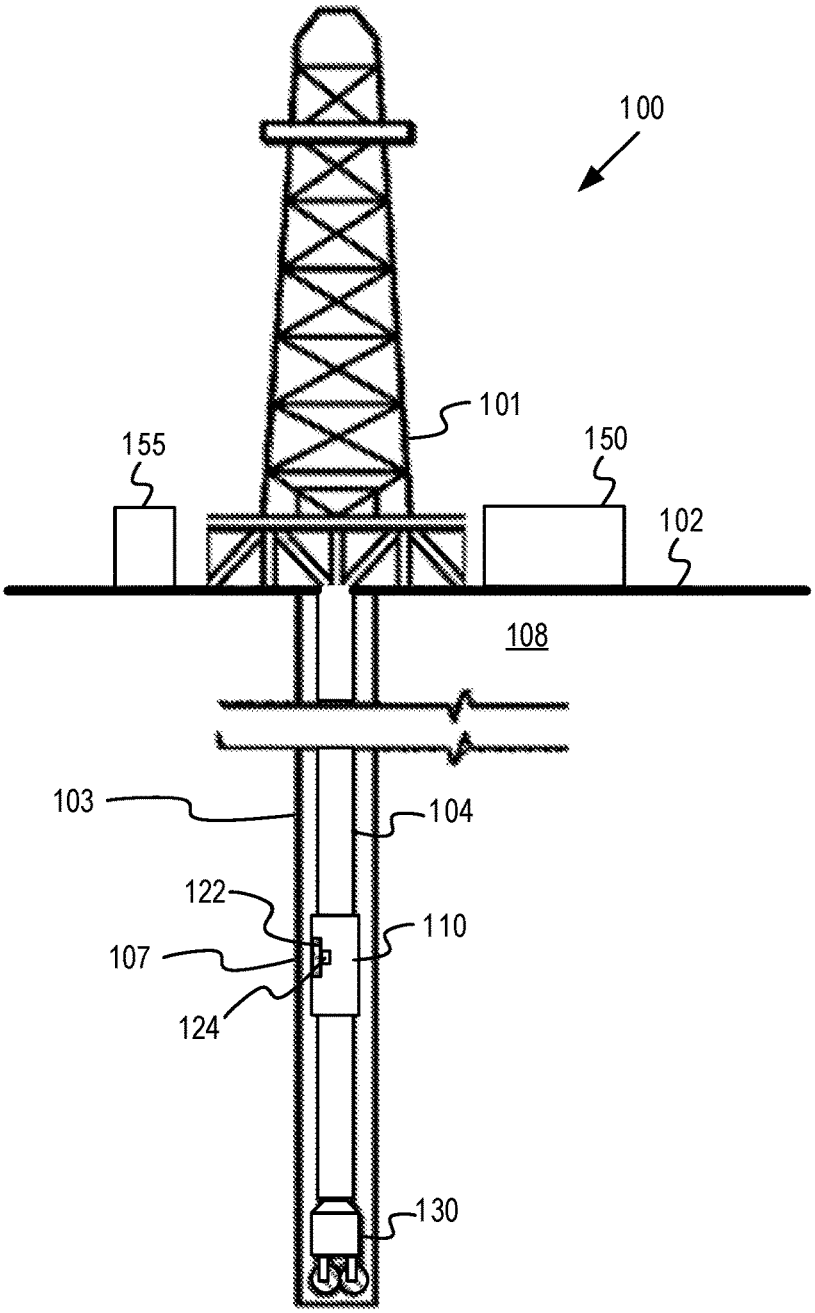
FIG. 1 is an elevation view of an onshore platform operating a downhole drilling assembly that includes a formation tester tool.

The description that follows includes example systems, methods, techniques, and program flows that embody embodiments of the disclosure. However, it is understood that this disclosure can be practiced without these specific details. For instance, this disclosure refers to a resistivity sensor in illustrative examples. Aspects of this disclosure can be instead applied to other sensors such as a pressure sensor, acoustic sensor, or temperature sensor. In other instances, well-known instruction instances, protocols, structures and techniques have not been shown in detail in order not to obfuscate the description.

Various embodiments relate to a formation tester tool used downhole in a borehole to measure various properties, samples, etc. from a formation during a formation testing operation. The formation tester tool can be part of a bottomhole assembly of a drill string or a wireline tool. During operation, the formation tester tool can include an extendable probe that has a probe end and an extendable member powered by a pneumatic cylinder, a solenoid, etc. The extendable probe can measure one or more fluid properties using sensors attached to the probe end. For example, an extendable probe can include a resistivity sensor at its probe end to measure fluid resistivity when the probe end is in fluid communication with the borehole wall. Fluid communication can be defined as communication to allow fluids such as liquids and gases from the surface of the borehole wall and the formation beyond the borehole wall to come into contact with the probe end.

The extendable member can be extended from a retracted position to an extended position to allow for fluid communication. In the retracted position, the extendable member is retracted such that the extendable probe is not in fluid communication with a borehole wall. In the extended position, the extendable member is extended in the direction of the borehole wall, pushing the probe end towards the borehole wall. A sealing pad can be positioned circumferentially around the probe end to provide a seal that enables the extendable probe to capture and seal formation fluid samples and keep the fluid samples isolated from non-formation fluids, debris, cuttings, etc. present within the borehole. If the sealing pad is not intact, forming a seal to isolate the wellbore from the formation may not be possible. In turn, the various properties, samples, etc. from the formation may not be accurately measured.

Various embodiments include a shield positioned between the sealing pad and the borehole wall to protect the sealing pad when the extendable probe is not in an extended position. In other words, the shield can remain in position to protect the sealing pad while the sealing pad is not engaged with the borehole wall. Engaging the borehole wall can be defined to include any type of physical contact with the borehole wall. At least a portion of the shield is not positioned between the sealing pad and the borehole wall while the sealing pad is sealingly engaged (i.e., engaged with sufficient force to form a seal) with the borehole wall. At least a portion of the shield may be single-use and unable to be repositioned between the sealing pad and the borehole wall after being removed from the position between the sealing pad and the borehole wall. Alternatively, the shield can be reusable by having a portion of the shield be repositionable between the sealing pad and the borehole wall after the extendable probe has been extended and then retracted.

The shield can prevent and/or reduce damage experienced by the sealing pad during movement through a wellbore, such as damage caused by strikes, abrasions, cuttings, or other physical encounters with a formation. The shield protects the sealing pad and is moved downhole with the sealing pad. Thus, the use of the shield can prolong the life of the sealing pad and decrease the probability of damage to the sealing pad.

Example Systems

FIG. 1 is an elevation view of an onshore platform operating a downhole drilling assembly that includes a formation tester tool. In FIG. 1, a drilling system 100 includes a drilling rig 101 located at the surface 102 of a borehole 103. The drilling system 100 also includes a pump 150 that can be operated to pump fluid through a drill string 104. The drill string 104 can be operated for drilling the borehole 103 through the subsurface formation 108 using the drill bit 130.

The drilling system 100 includes a formation tester tool 110 to sample formation fluid and determine one or more properties of the fluid. The formation tester tool 110 can be attached to the drill string 104 and lowered into the well, optionally as part of a bottomhole assembly. The formation tester tool 110 in this example includes a sealing pad 124 for engaging with a borehole wall 107. The sealing pad 124 is radially between the longitudinal axis of the formation tester tool 110 and the shield 122, which protects the sealing pad 124 from mechanical damage that might otherwise be caused by drill cuttings and debris flowing towards the surface, abrasive materials in drilling mud, and chemical agents that may degrade the sealing pad 124. Once a target well depth has been reached by the formation tester tool 110, a sealing operation of a formation testing operation can be performed to form a seal between the sealing pad 124 and the borehole wall 107 to establish fluid communication between a probe end attached to the sealing pad 124 and the borehole wall 107. During the sealing operation, an electrical signal can be transmitted to the formation tester tool to extend an extendable member which pushes the sealing pad towards the formation wall. During extension of the extendable member, at least a portion of the shield 122 can be moved or detached from a face of the sealing pad 124 to expose the sealing pad 124 to the borehole wall 107, allowing physical contact to occur between the sealing pad 124 and the borehole wall 107. Isolation of the formation fluid can prevent fluids or solids from infiltrating a sample of formation fluid before a formation testing operation is complete.

In some embodiments, drilling operations can be altered or stopped based on a formation analysis corresponding with information about the formation 108 as performed by the computer 155 using fluid properties determined from the fluid collected by the extendable probe. For example, if a formation analysis based on resistivity measurements taken by the extendable probe determines that a well is a dry well, the drilling operation can be stopped. Alternatively, if a formation analysis determines that a formation is at a different depth than previously predicted based on a pressure measurement that exceeds an expected pressure range for a formation, drilling direction can be changed to accommodate this depth change.

Figure 2:
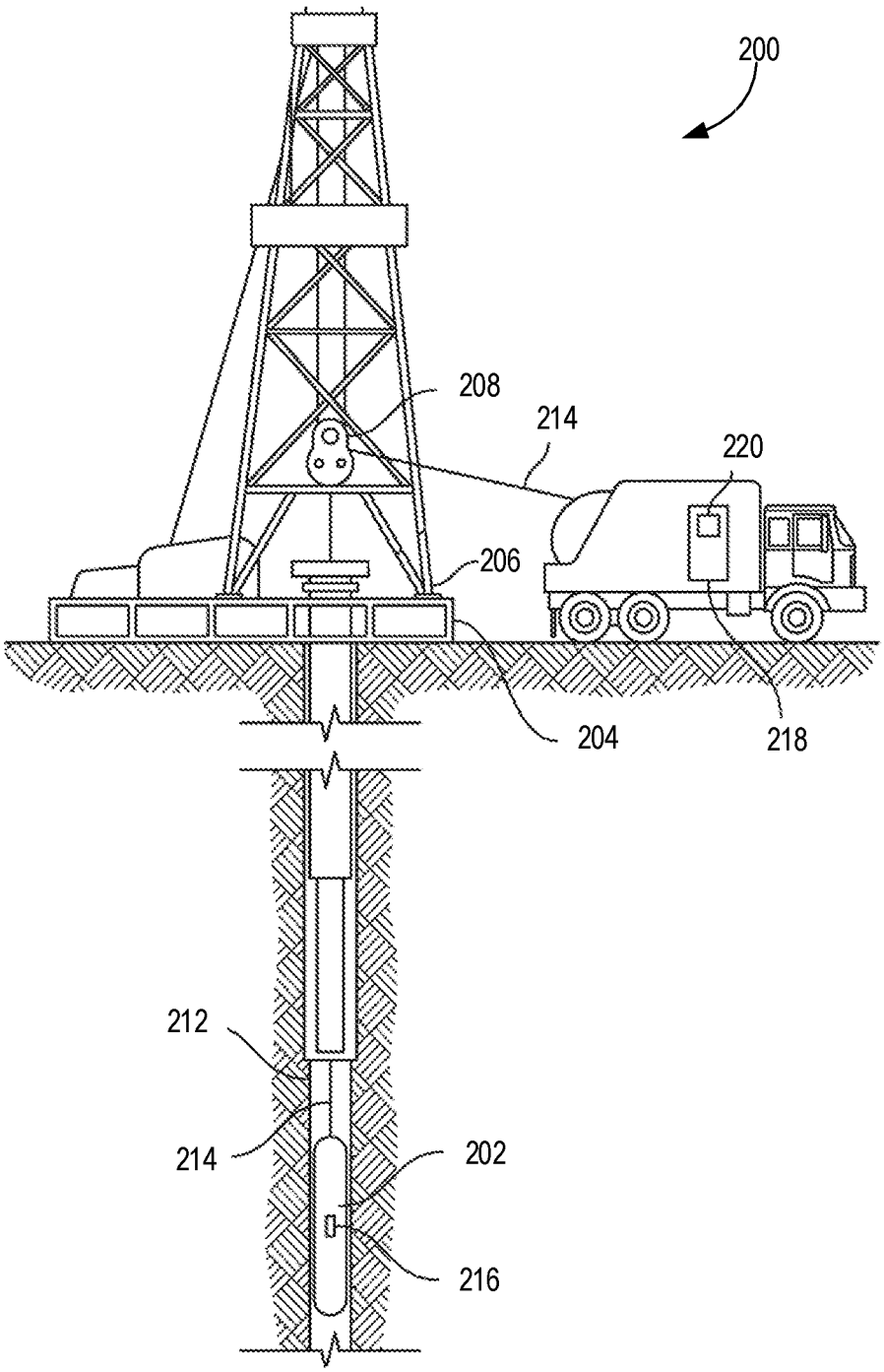
FIG. 2 is an elevation view of an onshore platform operating a wireline tool that includes a formation tester tool.

Alternatively, instead of being attached to an onshore platform operating a downhole drilling assembly, a formation tester tool can be a wireline tool. FIG. 2 is an elevation view of an onshore platform operating a wireline tool that includes a formation tester tool. The onshore platform 200 comprises a drilling platform 204 installed over a borehole 212. The drilling platform 204 is equipped with a derrick 206 that supports a hoist 208. The hoist 208 supports the formation tester tool 202 via the wireline cable 214. The formation tester tool 202 can be lowered by the wireline cable 214 into the borehole 212. Typically, the formation tester tool 202 is lowered to the bottom of the region of interest and subsequently pulled upward at a substantially constant speed.

The formation tester tool 202 is suspended in the borehole by a wireline cable 214 that connects the formation tester tool 202 to a surface system 218 (which can also include a display 220). In some embodiments, the formation tester tool 202 can include a shield 216, analogous to the shield 122 described in FIG. 1. The shield 216 protects a sealing pad and the extendable probe attached to the sealing pad. An extendable arm in the formation tester tool 202 can be radially extended to push the extendable probe and the sealing pad radially outward in order to capture formation fluid and measure formation fluid properties. The measurement data can be communicated to a surface system 218 via the wireline cable 214 for storage, processing, and analysis. The formation tester tool 202 can be deployed in the borehole 212 on coiled tubing, jointed drill pipe, hard-wired drill pipe, or any other suitable deployment technique. In some embodiments, the wireline cable 214 can include sensors to characterize the pipe containing the optical cable and adjacent pipes over time. The surface system 218 can be provided with electronic equipment for various types of signal processing.

Example Formation Tester Tools

Figure 3:
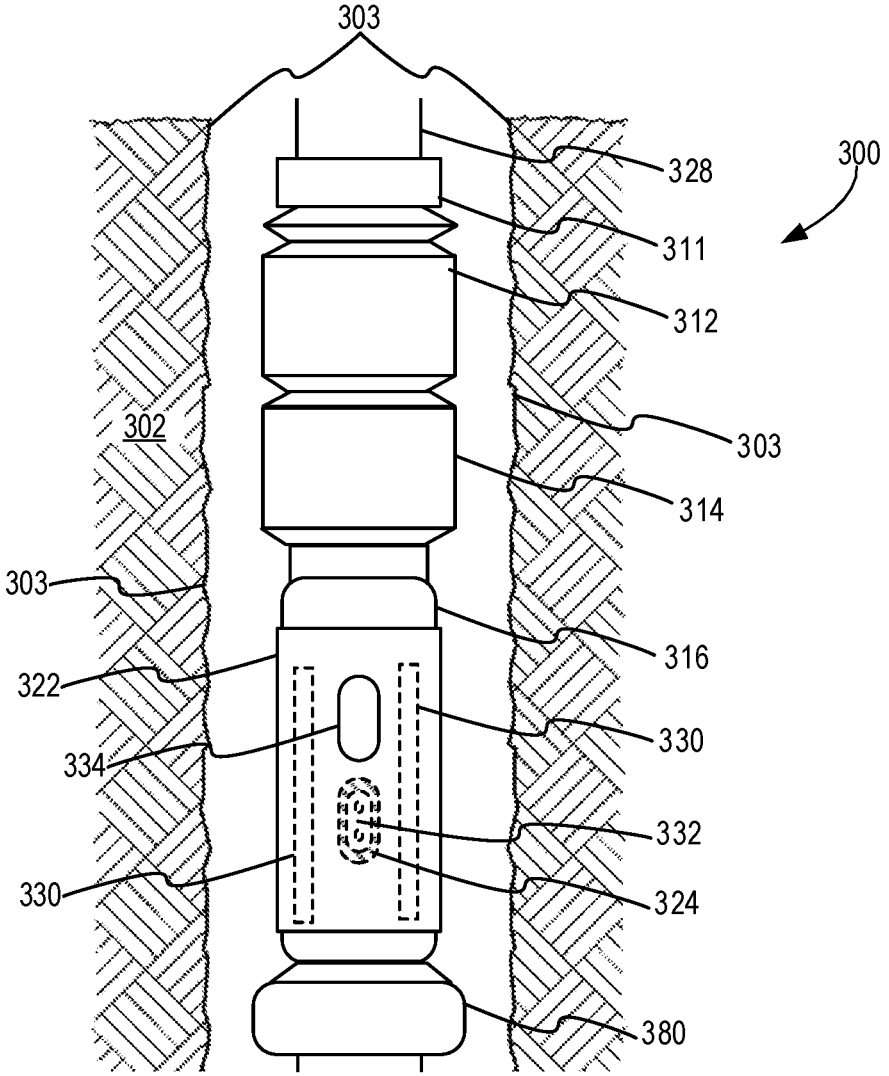
FIG. 3 is an elevation view of a formation tester tool having an extendable probe in a retracted position and including a sealing pad with a movable shield.

FIG. 3 is an elevation view of a formation tester tool having an extendable probe in a retracted position and including a sealing pad with a movable shield. With reference to FIG. 1 and FIG. 2 above, the formation tester tool 300 can be used analogously in place of either the formation tester tool 110 or the formation tester tool 202. The formation tester tool 300 is attached to the drill pipe 328. In the illustrated embodiment, the formation tester tool 300 includes a power and communication device 312 that provides electrical power and data communication for the formation tester tool 300. Additionally, the device 312 can provide data communications to a controller 311 above the device 312. In alternative embodiments, the controller 311 can be located further uphole in the well or at the surface of the earth. The formation tester tool 300 also includes a motor housing 314 and a probe housing 316.

The motor housing 314 is operably connected with the probe housing 316 and the shield 322. The motor housing 314 can include a motor and/or hydraulic pump that is operated to generate mechanical/hydraulic energy and supply the mechanical/hydraulic energy into the interior of the probe housing 316. For example, the mechanical/hydraulic energy can be supplied to the probe housing 316 through an arm or via a fluid conduit. Operation of the motor housing 314 can be controlled by the control system via the device 312.

The probe housing 316 includes an extendable probe 332. FIG. 3 illustrates an end of the extendable probe 332 in a retracted position in the probe housing 316. During operation, the extendable probe 332 can be moved to an extended position—extending out toward a borehole wall 303. The probe housing 316 includes a sealing pad 324 that is positioned circumferentially around the end of the extendable probe 332. In this example, the shield 322 is positioned circumferentially on an outer surface of the probe housing 316. The shield 322 has a radius less than the radius of at least one other component of the formation tester tool 300, putting it within a circumference of the formation tester tool. The shield 322 includes a shield aperture 334. Also, beveled tracks 330 are positioned between an inner surface of the shield 322 and the outer surface of the probe housing 316.

As the formation tester tool 300 is lowered into the borehole, the shield 322 is in a covered position to cover the sealing pad 324 and the end of the extendable probe 332. In the covered position, the shield 322 is positioned radially between a face of the sealing pad 324/end of the extendable probe 332 and the borehole wall 303. In the covered position, the shield 322 protects the sealing pad 324 from damage caused by mechanical stress (e.g., collisions with rocks or drill cuttings). The radius of the shield 322 with respect to the axis of the formation tester tool 300 can be less than the radius of at least one a portion of the formation tester tool 300 to reduce the exposure of the shield 322 to the borehole and potentially damaging materials. For example, the radius of the shield 322 can be less than the radius of a barrier 380 of the formation tester tool 300. As shown in FIG. 3, the shield 322 is in a covered position. The shield 322 can remain in the covered position any time the formation testing is not occurring. For example, the shield 322 can cover the sealing pad 324 and the end of the extendable probe 332 while the formation tester tool 300 is being moved to a testing depth, after the formation testing is complete.

Once the formation tester tool 300 has reached a depth for testing the formation, formation testing can begin. As part of the formation testing, the shield 322 is moved to an uncovered position. Mechanical energy from the motor within motor housing 314 can be used to provide the force to a motor arm to longitudinally move the shield 322. In this example, the motion of the shield 322 can be guided by the beveled tracks 330. For example, the shield 322 can include grooves that operably engages with the beveled tracks 330. The shield 322 can be moved to align the shield aperture 334 with the sealing pad 324. Such alignment between the shield aperture 334 and the sealing pad 324 provides an opening so that the sealing pad 324 can be radially moved through the shield aperture 334 with respect to the cylindrical axis of the formation tester tool 300 without being impeded by a portion of the shield 322. Thus, once the shield 322 is in the uncovered position, the sealing pad 324 and the extendable probe 332 can extend outward to the borehole wall 303.

After the shield 322 is in the uncovered position, a sealing operation of the formation testing operation can be initiated. As described above, the extendable probe 332 can include an extendable member attached to the end of the extendable probe 332. During the sealing operation, the sealing pad 324 can be radially pushed outward by extending the extendable member of the extendable probe 332. The extendable member can be extended using various extension mechanisms, such as using a hydraulic device or a solenoid device. For example, the extendable member can be extended using a pneumatic cylinder device to push a piston attached to an end of the extendable member. After the extendable member is extended, the sealing pad 324 comes into contact and engages with the borehole wall 303 to form a sealed chamber comprising the space between the sealing pad 324, the borehole wall 303 and the end of the extendable probe 332. The sealing pad 324 can be formed from a sealing material, such as an elastomer, and can form a seal with the borehole wall 303 to create a sealed chamber. A fluid from the formation can be captured in the sealed chamber formed by the sealing pad 324 and the borehole wall 303, establishing an isolated fluid connection between the end of the extendable probe 332 and the borehole wall 303. An isolated fluid connection can provide a means for the end of the extendable probe 332 to be in fluid communication with the borehole wall 303, allowing the end of the extendable probe 332 to measure fluid properties (e.g., resistivity, conductivity, composition, viscosity, temperature, pressure, etc.). Measuring fluid properties with the extendable probe 332 can include measuring fluid properties both inside of the sealed chamber and outside of the sealed chamber. For example, measuring fluid properties inside of the sealed chamber can include measuring fluid properties at sensors attached to the end of the probe 332. An example of measuring fluid properties outside of the sealed chamber can include measuring fluid properties using a sensor inside of the formation tester tool 300.

Figure 4:
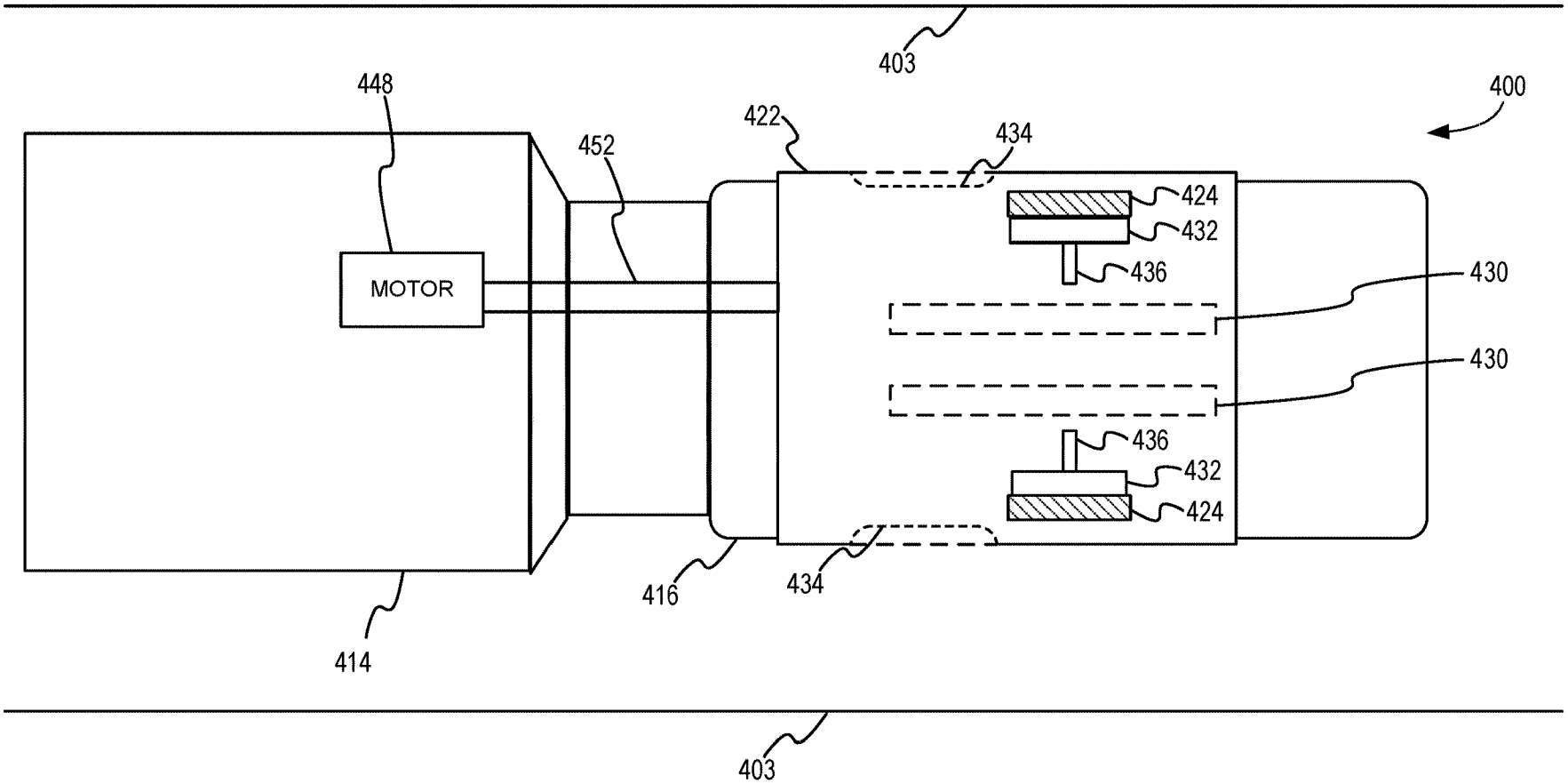
FIG. 4 is a cross-sectional view of a formation tester tool having an extendable probe in a retracted position and including a sealing pad with a motor-controlled shield in a covered position.

FIG. 4 is a cross-sectional view of a formation tester tool having an extendable probe in a retracted position and including a sealing pad with a motor-controlled shield in a covered position. With reference to FIG. 4, a formation tester tool 400 is positioned in a borehole having a borehole wall 403. The formation tester tool 400 includes a motor housing 414 and a probe housing 416. The motor housing 414 and the probe housing 416 are analogous to the motor housing 314 and the probe housing 316 of FIG. 3, respectively. A shield 422 is positioned circumferentially on an outer surface of the probe housing 416 and includes a plurality of shield apertures 434. The shield 422 is slidably movable relative to the probe housing 416 longitudinally in the borehole. The probe housing 416 includes beveled tracks 430 that are positioned between an inner surface of the shield 422 and the outer surface of the probe housing 416 to guide the longitudinal motion of the shield 422. The motor housing 414 includes a motor 448. An arm 452 connects the motor 448 to the shield 422. The motor 448 can be used to control the motion of the shield 422 by pushing and pulling the arm 452. In FIG. 4, the shield 422 is in a covered position. In the covered position, the shield 422 covers sealing pads 424 and extendable probes 432 from exposure to non-formation fluids, debris, cuttings, etc. present within the borehole.

During a formation testing operation, the motor 448 can be powered from a power source inside of the motor housing 414, other locations downhole, or at the surface of the earth. The motor 448 can be controlled from a processor in communication with the motor 448. The processor can be in the motor housing 414, other locations downhole, or at the surface of the earth. In some embodiments, activation signals from the surface can be used to induce the motor 448 to activate and transfer mechanical energy to move the shield 422 through the arm 452. These activation signals can be transmitted via wireline, electromagnetic waves, mud pulse telemetry, wired pipes, etc. The motor 448 can move the shield 422 using the arm 452 along the beveled track 430 until the shield apertures 434 aligns with the sealing pads 424 as shown in FIG. 5, further described below.

Figure 5:
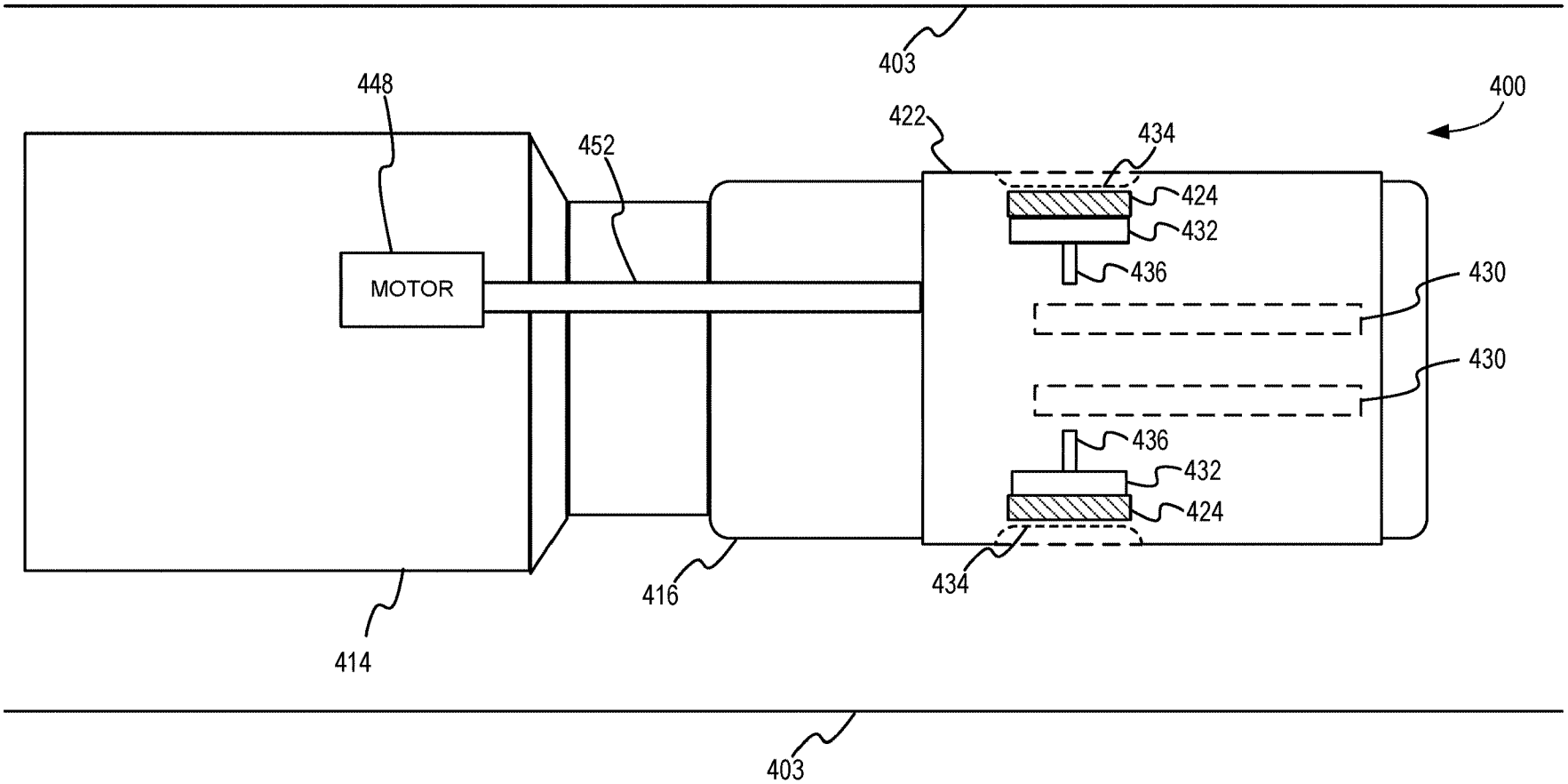
FIG. 5 is a cross-sectional view of a formation tester tool having an extendable probe in a retracted position and including a sealing pad with a motor-controlled shield in an uncovered position.

FIG. 5 is a cross-sectional view of a formation tester tool having an extendable probe in a retracted position and including a sealing pad with a motor-controlled shield in an uncovered position. FIG. 5 shows the formation tester tool 400 of FIG. 4 after the motor 448 has pushed the shield 442 into alignment with the sealing pads 424. The shield 442 is now in an uncovered position. In some embodiments, the extendable members 436 can remain in retracted positions during movement of the shield 442. Alternatively, the extendable members 436 can extend while the shield 442 is in motion. In the uncovered position, the faces of the sealing pads 424 can be pushed through the shield apertures 434 by the extendable members 436 without being impeded by the shield 422. The extendable members 436 can be moved using a pneumatic device, mechanical assembly, solenoid, etc. The extendable members 436 can be extended until the sealing pads 424 sealingly engage with the borehole wall 403 to form a sealed chamber as shown in FIG. 6, further described below.

Figure 6:
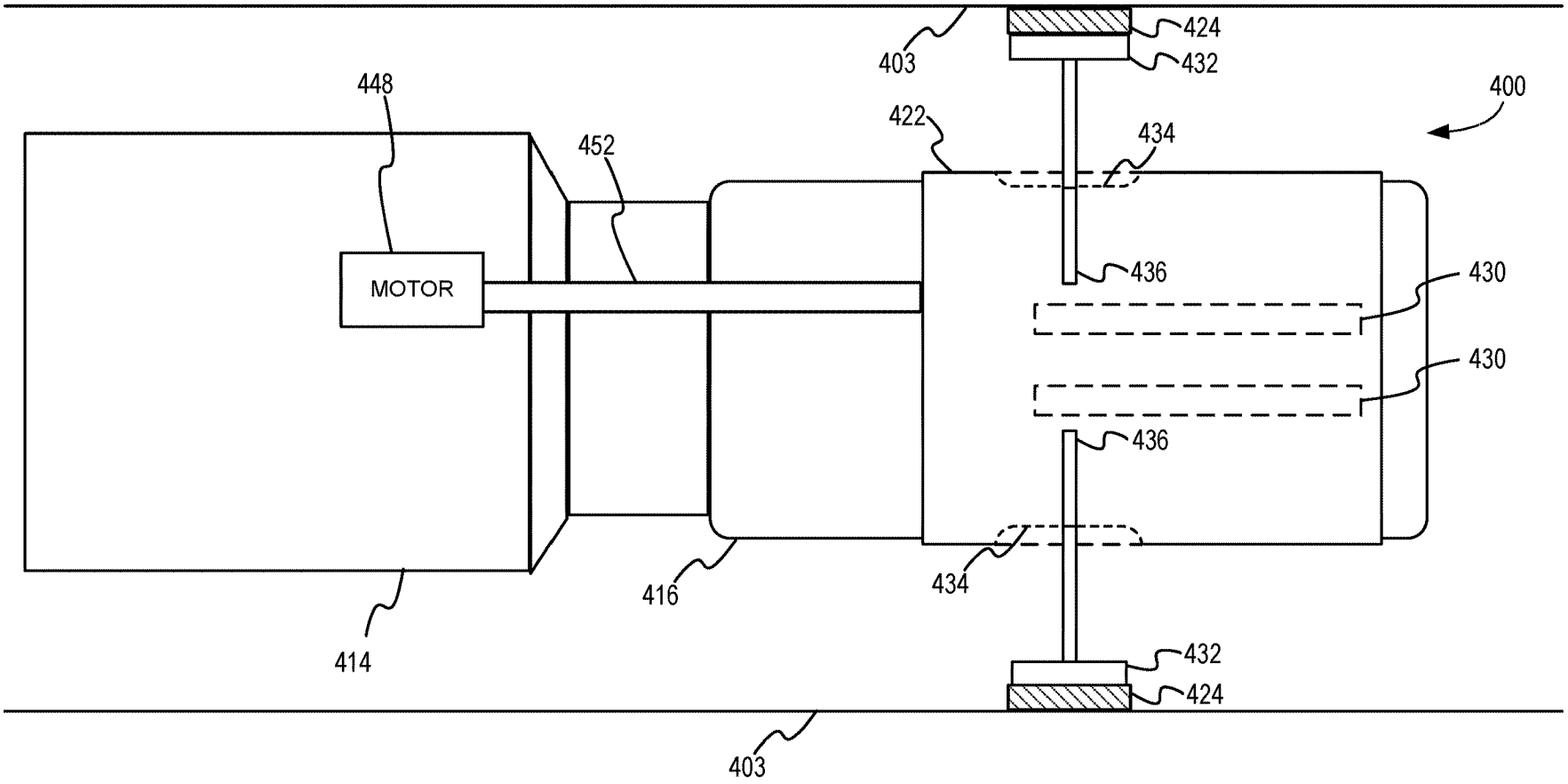
FIG. 6 is a cross-sectional view of a formation tester tool having an extendable probe in an extended position and including a sealing pad with a motor-controlled shield in an uncovered position.

FIG. 6 is a cross-sectional view of a formation tester tool having an extendable probe in an extended position and including a sealing pad with a motor-controlled shield in an uncovered position. FIG. 6 shows the formation tester tool 400 of FIGS. 4-5 after extension of the extendable probes 432 through the shield apertures 434. Once aligned, the sealing pads 424 can be pushed towards the borehole wall 403 by extending the extendable members 436 through the shield 422 at the shield apertures 434. Once faces of the sealing pads 424 comes into contact with the borehole wall 403, the sealing pads 424 can form sealed chambers between the extendable probes 432, sealing pads 424, and the borehole wall 403. Each sealed chamber can capture formation fluid from the borehole wall 403, and can isolate the fluid in the sealed chamber from fluids that are not from the formation.

The probe housing 416 can include sensors or devices which can measure properties of formation fluid that enter the probe housing 416 through fluid inlets in the extendable members 436. Alternatively, or in addition, the extendable probes 432 can include sensors at their ends to directly measure one or more fluid properties in the sealed chamber formed by the sealing pads 424. Once one or more measurements are complete or the formation fluid has entered the probe housing for measurement, the extendable members 436 can be retracted to pull the sealing pads 424 back within the circumference of the shield 422. In some embodiments, after retraction of the extendable members 436 by the motor 448, the shield 422 can be repositioned to a covered position by longitudinally moving the shield 422 until the shield apertures 434 are no longer aligned with the sealing pads 424. Once in the covered position, the shield 422 would be positioned between the sealing pads 424 and the borehole wall 403. For example, after the extendable members 436 have retracted, the shield 422 can be repositioned to the position of the shield 422 shown in FIG. 4 by the motor 448.

Figure 7:
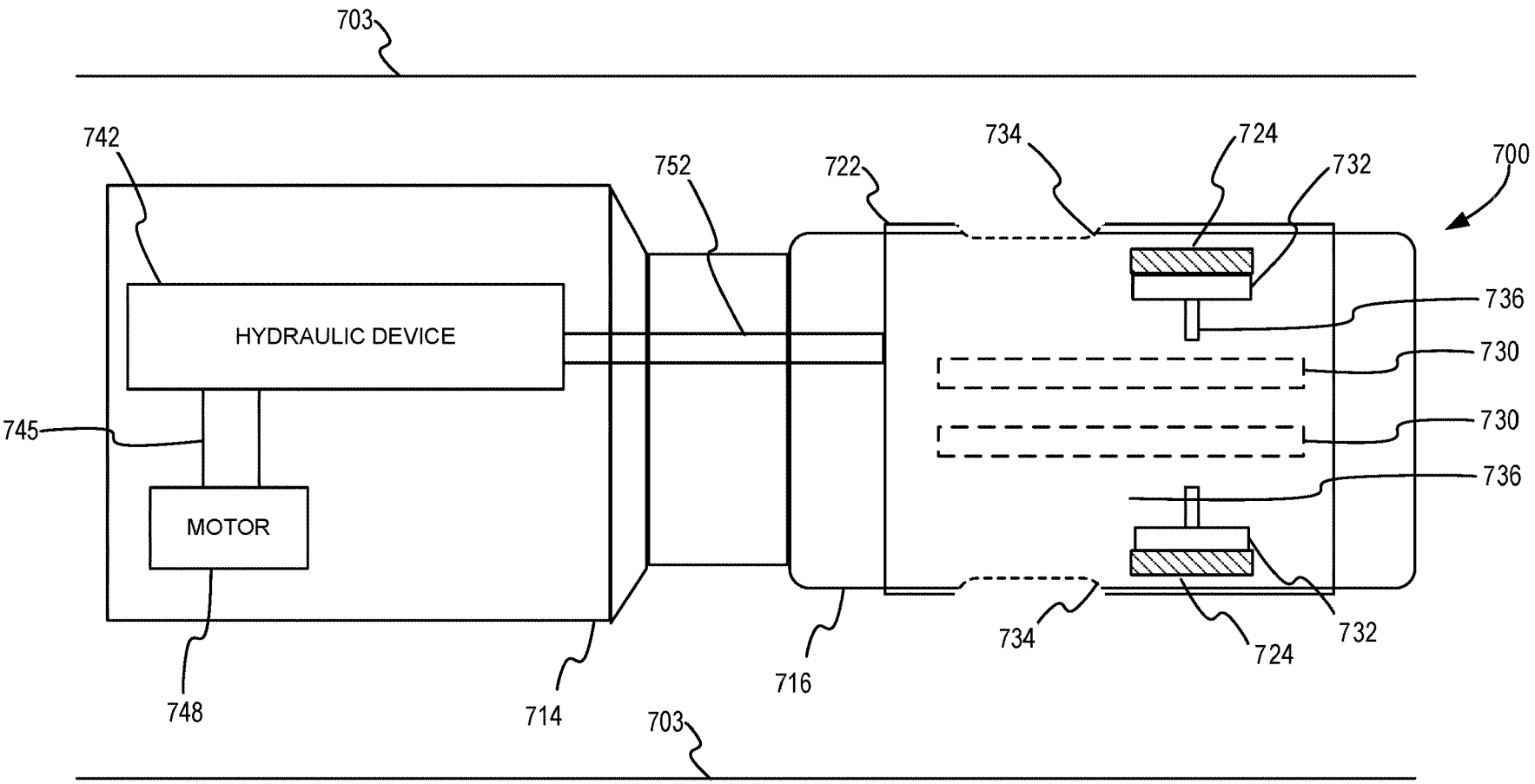
FIG. 7 is a cross-sectional view of a formation tester tool having an extendable probe in a retracted position and including a sealing pad with a hydraulic-controlled shield in a covered position.

FIG. 7 is a cross-sectional view of a formation tester tool having an extendable probe in a retracted position and including a sealing pad with a hydraulic-controlled shield in a covered position. With reference to FIG. 7, a formation tester tool 700 is positioned in a borehole having a borehole wall 703. The formation tester tool 700 includes a motor housing 714 and a probe housing 716. The motor housing 714 and the probe housing 716 are analogous to the motor housing 314 and the probe housing 316 of FIG. 3, respectively. A shield 722 is positioned circumferentially on an outer surface of the probe housing 716 and includes a plurality of shield apertures 734. The shield 722 is slidably movable relative to the probe housing 716 longitudinally in the borehole. The probe housing 716 includes beveled tracks 730 that are positioned between an inner surface of the shield 722 and the outer surface of the probe housing 716 to guide the longitudinal motion of the shield 722. The motor housing 714 includes a motor 748 and a hydraulic device 742. A connection 745 connects the hydraulic device 742 and the motor 748. A fluid conduit 752 connects the hydraulic device 742 and the probe housing 716. The hydraulic device 742 can be used to control the motion of the shield 722 by changing the pressure in the fluid conduit 752. In FIG. 7, the shield 722 is in a covered position. In the covered position, the shield 722 covers shield pads 724 and extendable probes 732 from exposure to non-formation fluids, debris, cuttings, etc. present within the borehole.

During a formation testing operation, the motor 748 can be powered from a power source inside of the motor housing 714, other locations downhole, or at the surface of the earth. The motor 748 can provide mechanical energy to the hydraulic device 742 through the connection 745, and can include a turbine, piston, or other means of converting mechanical energy to hydraulic energy. In cases where the hydraulic device 742 is connected to a pump at the surface, the hydraulic device 742 can also be powered by water, drilling mud, or other fluid flowing through the motor housing 714. The hydraulic device 742 and motor 748 can be jointly or independently controlled from a processor (in communication with either or both the hydraulic device 742 and the motor 748), wherein the processor can be in the motor housing 714 or at the surface of the earth. In some embodiments, activation signals from the surface can be used to induce the motor 748 and/or the hydraulic device 742 to transfer mechanical or hydraulic energy, respectively. These activation signals can be transmitted via wireline, electromagnetic waves, mud pulse telemetry, wired pipes, etc.

The motor 748 can provide mechanical energy to the hydraulic device 742. The mechanical energy can be used to increase hydraulic pressure in the hydraulic device 742. The hydraulic device can increase the pressure in the fluid conduit 752 to provide hydraulic energy to a piston that longitudinally moves the shield 722. The hydraulic device 742 can move the shield 722 using the fluid conduit 752 along the beveled tracks 730 until the shield apertures 734 is aligned with the shield pads 724, similar to the shield apertures 434 alignment shown above in FIG. 5. In addition, the hydraulic energy provided through the fluid conduit 752 can be used to extend the extendable members 736 to push the shield pads 724 radially outwards through the shield apertures 734. Alternatively, the hydraulic energy can first be converted into mechanical energy using a solenoid device. The mechanical energy of the solenoid device can then be used to longitudinally move the shield 722 along the beveled track 730 and extend the extendable members 736. The extendable members 736 can be extended until the shield pads 724 sealingly engage with the borehole wall 703 to form sealed chambers, similar to the sealed chambers formed between the sealing pads 424 and the borehole wall 403 as shown in FIG. 6.

Figure 8:
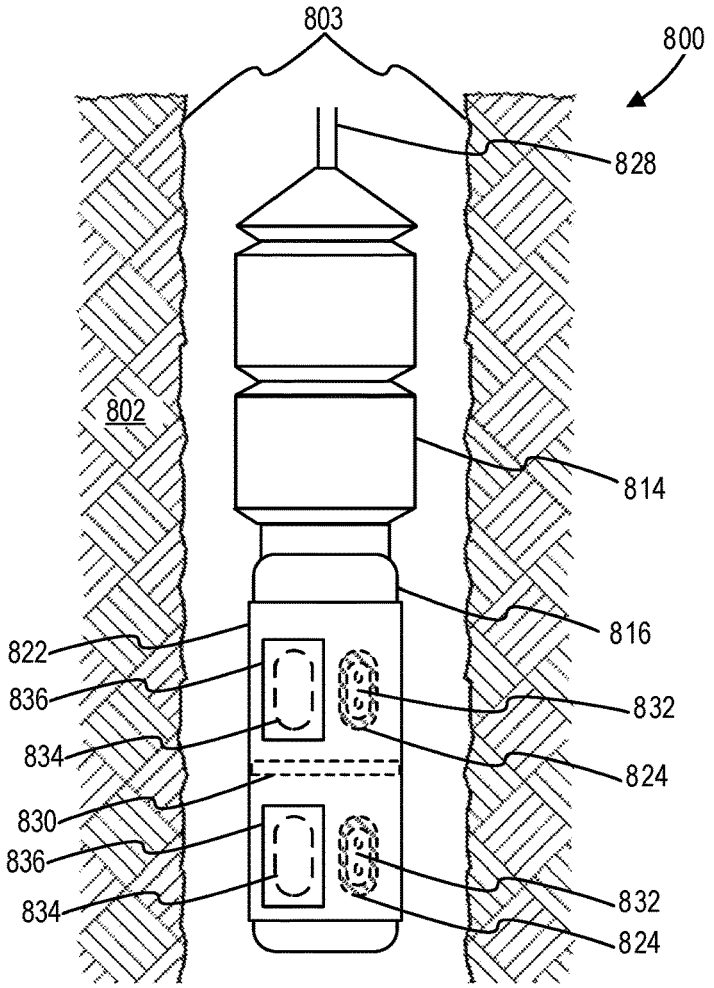
FIG. 8 is an elevation view of a formation tester tool having an extendable probe in a retracted position and including a sealing pad with a rotatable shield.

FIG. 8 is an elevation view of a formation tester tool having an extendable probe in a retracted position and including a sealing pad with a rotatable shield. With reference to FIG. 8, a formation tester tool 800 is positioned in a borehole having a borehole wall 803 with a surrounding formation 802. The formation tester tool 800 includes a motor housing 814 and a probe housing 816. The formation tester tool 800 is attached to a wireline cable 828. While depicted as a wireline tool, the formation tester tool 800 can also be incorporated into a bottomhole assembly of a drill string (as described above). The formation tester 800 has a shield 822 that can act as an alternative embodiment of the shield 322 of FIG. 3. The shield 822 is positioned circumferentially on an outer surface of the probe housing 816 and includes shield apertures 834 underneath aperture plates 836. The aperture plates 836 can be a portion of the shield 822 or physically separate from the shield 822. The shield 822 is slidably rotatable relative to the probe housing 816 in the borehole. The probe housing 816 also includes a beveled track 830 running perpendicular to the axis of the probe housing 816 and positioned between an inner surface of the shield 822 and the outer surface of the probe housing 816 to guide the rotational motion of the shield 822. In FIG. 8, the shield 822 is in a covered position. In the covered position, the shield 822 covers sealing pads 824 and extendable probes 832 from exposure to non-formation fluids, debris, cuttings, etc. present within the borehole.

The motor housing 814 can house a motor. During a formation testing operation, the motor can be powered from a power source in the motor housing 814, other locations downhole, or at the surface of the earth. The motor can be controlled from a processor in communication with the motor. The processor can be in the motor housing 814, other locations downhole, or at the surface of the earth. Based on instructions from the processor, the motor in the motor housing 814 rotates the shield 822. For example, a gear in the probe housing 816 can transfer force from the motor in the motor housing 814 to rotate the shield 822 around the probe housing 816. The rotation of the shield 822 can be guided by the beveled track 830, which operatively engages the shield 822 with the probe housing 816. The shield 822 can be rotated until the shield apertures 834 are aligned with the sealing pads 824.

The apertures plates 836 are radially fixed outside of the shield apertures 834. The aperture plates 836 can be secured to the shield 822 to protect the shield apertures 834 using various securing means, such as through the use of plastic fasteners, adhesives, shear pins, soldering, etc. The aperture plates 836 can cover the shield apertures 834 when experiencing an external force (i.e., a force experienced from beyond the outer radius of the aperture plates 836). The aperture plates 836 can be rendered unusable to cover the sealing pads 824 by being detached from the shield apertures 834 when experiencing the same magnitude of force when the force is applied from inside the shield 822. For example, the aperture plates 836 can remain fastened to the shield 822 when a force of 100 kilonewtons is applied onto the shield 822 from outside the radius of the aperture plates 836. In response to a force of 100 kilonewtons being applied onto the aperture plates 836 from the sealing pads 824, the aperture plates 836 can detach from the shield 822.

In some embodiments, the aperture plates 836 can be completely detached. For example, no portion of the aperture plates 836 can be attached to the formation tester tool 800 after the aperture plates 836 are completely detached. Alternatively, a portion of the aperture plates 836 can become broken and/or detached from the shield 822. For example, the aperture plates 836 can have a boundary of thinned material such that an applied force from the sealing pads 824 can break the aperture plates 836 at the boundary of the thinned material. Extendable members of the extendable probes 832 can extend to push the sealing pads 824 radially outwards with sufficient force to completely detach the aperture plates 836 from the formation tester tool 800. Once the aperture plates 836 are detached, the extendable members of the extendable probes 832 can be extended to push the sealing pads 824 into the borehole wall 803 to form sealed chambers for capturing formation fluid.

Figure 9:
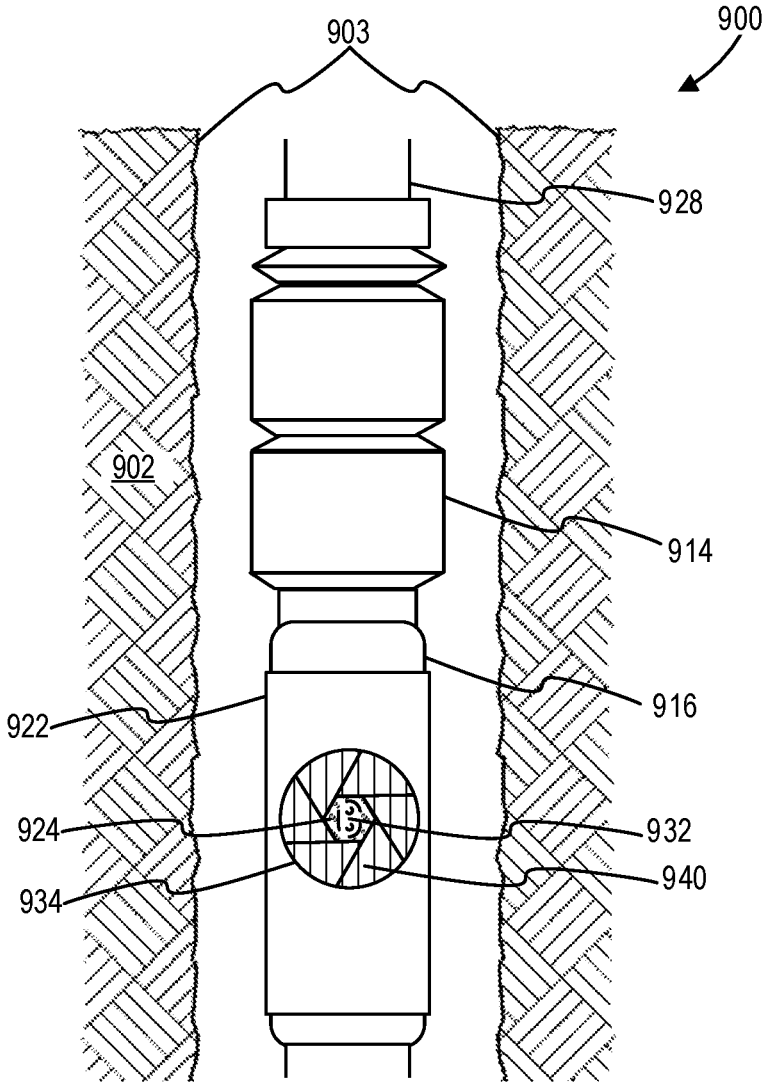
FIG. 9 is an elevation view of a formation tester tool having an extendable probe in a retracted position and including a sealing pad with a shutter around a shield aperture.

FIG. 9 is an elevation view of a formation tester tool having an extendable probe in a retracted position and including a sealing pad with a shutter around a shield aperture. With reference to FIG. 9, a formation tester tool 900 is positioned in a borehole having a borehole wall 903. The formation tester tool 900 is attached to a drill string 928. While depicted as part of a drill string, the formation tester tool 900 can also be a wireline tool (as described above). The formation tester tool 900 includes a motor housing 914 and a probe housing 916. The motor housing 914 and probe housing 916 can be analogous to the motor housing 314 and the probe housing 316 of FIG. 3, respectively. A shield 922 is positioned circumferentially around an outer surface of the probe housing 916 and includes one or more shield apertures 934 protected by shutters 940. In FIG. 9, the shield 922 is in a covered position. In the covered position, the shield 922 covers sealing pads 924 and extendable probes 932 from exposure to non-formation fluids, debris, cuttings, etc. present within the borehole. In FIG. 9, the shield 922 is transitioning from a covered position to an uncovered position. The shield 922 can be reversibly transitioned from an uncovered position to a covered position by opening and closing the shutters 940.

During a formation testing operation, mechanical energy can be supplied from a motor in the motor housing 914 to open or close the shutters 940. When the shutters 940 are sufficiently opened to allow the sealing pad 924 to pass through without damaging the shutters 940 or the sealing pad 924, a mechanical or pneumatic device can extend an extendable member of the extendable probe 932. Extending the extendable member pushes the sealing pad 924 radially outward until the sealing pad 924 is sealingly engaged with the borehole wall 903. In some embodiments, the extendable member can be retracted after being extended, and the shield aperture 934 can be covered again by closing the shutters 940 using the motor in the motor housing 914.

Example Operations

Figure 10:
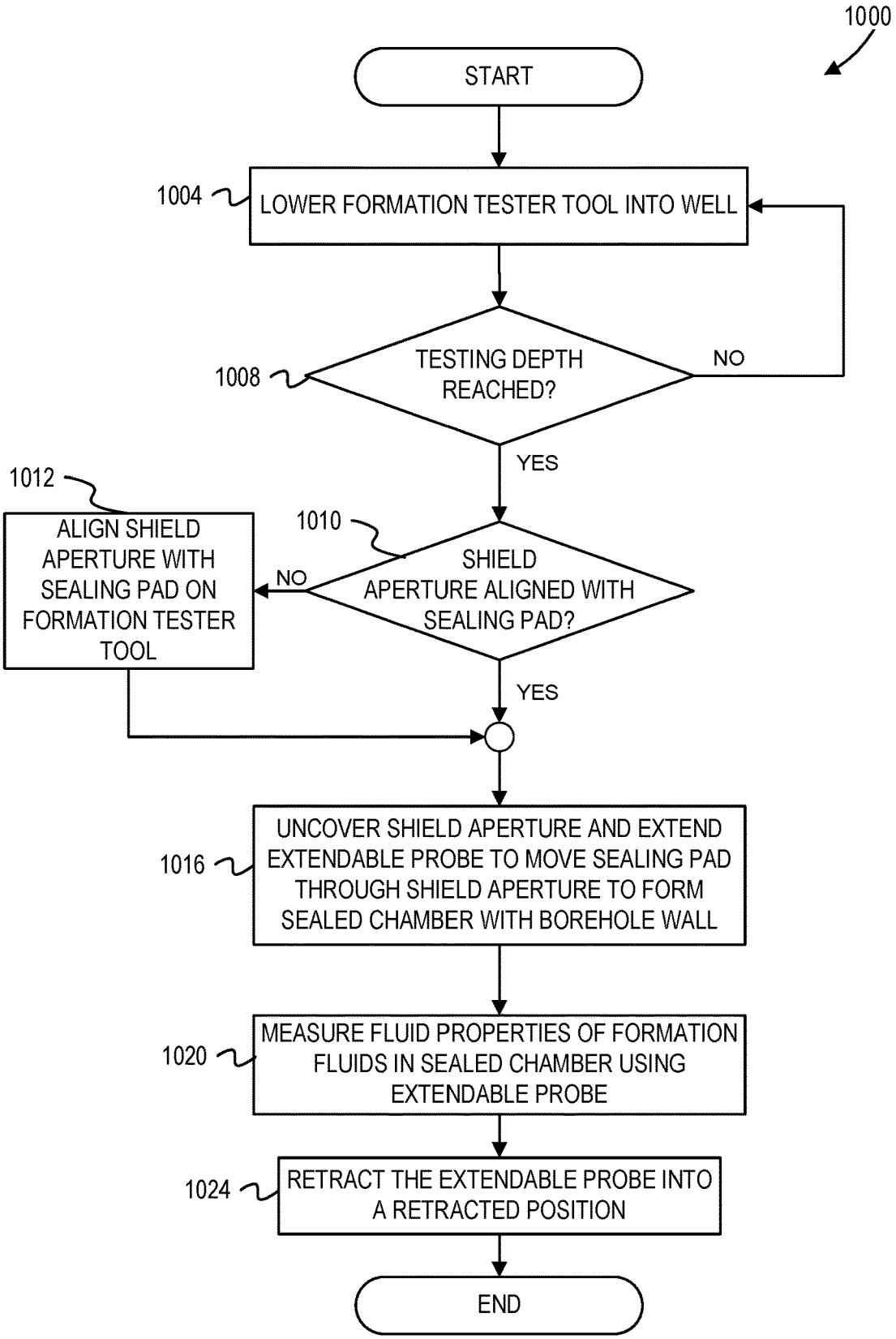
FIG. 10 is a flowchart of operations to test a formation with a formation tester tool having an extendable probe and a sealing pad with a movable shield.

FIG. 10 is a flowchart of operations to test a formation with a formation tester tool having an extendable probe and a sealing pad with a movable shield. FIG. 10 is a flowchart 1000 that includes operations that are described in reference to the formation tester tools of FIGS. 3-9. Operations of the flowchart 1000 start at block 1004.

At block 1004, a formation tester tool is lowered into the well. The formation tester tool can be lowered while attached to a wireline, a drill pipe, etc. For example, during a drilling operation, the formation tester tool can be part of a bottomhole assembly of a drill string and lowered during the drilling operation.

At block 1008, a determination is made of whether a testing depth is reached. In some embodiments, the testing depth can be determined to have been reached when a measured depth reaches a target value. For example, a determination can be made that the formation tester tool has reached a target depth of 5000 feet. The target depth can be repeated over any arbitrary constant or variable interval. For example, a target depth can be repeated every 5 feet from a range of 100 feet to 20000 feet. Alternatively, a determination can be made that a testing depth is reached when one or more triggering conditions based on measurements are met. For example, a testing depth can be reached when a sensor determines that a hydrocarbon-rich layer has been encountered based on a measured neutron signal being within an expected range. If a testing depth is not reached, operations of the flowchart 1000 continue at block 1004. If the testing depth is reached, operations of the flowchart 1000 continue at block 1010.

At block 1010, a determination is made of whether a shield aperture is aligned with the sealing pad. In some embodiments, a device can be used to determine whether the shield aperture is aligned with the sealing pad. For example, with reference to FIG. 3, an electric device attached the shield 322 can be set to provide an alignment signal to an instrument at the surface of the earth when the electric device comes into contact with a specified position on the probe housing 316. Alternatively, a determination can be made that a shield aperture is aligned with the sealing pad by default due to the design of the shield with reference to the pad sealing. For example, with further reference to FIG. 9, a determination can be made that the shield aperture 934 and the sealing pad 924 are aligned due to the initial position of the shield aperture 934 with reference to the extendable probe 932. If the shield aperture is aligned with the sealing pad, then operations of the flowchart 1000 continue at block 1016. Otherwise, operations of the flowchart 1000 continue at block 1012.

At block 1012, a shield aperture is aligned with the sealing pad on the formation tester tool. Aligning a shield aperture with a sealing pad can allow the sealing pad to move through the shield at the shield aperture. Shield aperture alignment can be achieved by applying mechanical force to move at least a portion of the shield. Sources or intermediaries of the mechanical force can include a motor, hydraulic device, solenoid, etc. For example, with reference to FIG. 3, the shield 322 can be moved downwards until the shield aperture 334 is aligned with the sealing pad 324 using a motor in the motor housing 314.

At block 1016, the shield aperture is uncovered, and the extendable probe is extended to move the sealing pad through the shield aperture to form a sealed chamber with a borehole wall. In some embodiments, the shield aperture is already uncovered, and an extendable member can push the sealing pad through the shield aperture in the radial direction. For example, with reference to FIG. 5, the sealing pads 424 can be pushed radially outward through the shield apertures 434 by extending the extendable members 436 to form a sealed chamber with the borehole wall 403. Alternatively, the shield aperture can be covered, and is uncovered before or during moving the sealing pad through the shield aperture. For example, with reference to FIG. 8, once the shield 822 is rotated and the shield apertures 834 is aligned with the sealing pads 824, the sealing pads 824 can be pushed radially outward by an extendable member. The sealing pads 824 can continue to apply force until the aperture plates 836 detach from the shield 822. Alternatively, the shield aperture can be covered or uncovered using a mechanism, wherein the mechanism can be operated to open before the sealing pad moves through the shield. For example, with reference to FIG. 9, the shutters of the shield aperture 934 can be opened to allow the sealing pad 924 to move through the shield 922.

At block 1020, one or more fluid properties of the formation fluid inside the sealed chamber are measured using the extendable probe. Fluids from the formation can include various gases and liquids, and are isolated from fluid in the borehole due to the seal formed by the sealing pad. The formation fluid can be measured by sensors on the extendable probe. Alternatively, or in addition, the formation fluid can flow through an extendable member into a probe housing for further measurements. For example, with reference to FIG. 6, the extendable probe 432 can measure fluid properties such as the resistivity and viscosity of the formation fluid in the sealed chamber formed by the sealing pads 424.

At block 1024, an extendable probe is retracted into a retracted position. The extendable member of the extendable probe can be retracted once fluid properties have been measured by the extendable probe. In some embodiments, at least a portion of the shield can be repositioned to the covered position to protect the sealing pad after the extendable probe is in the retracted position. For example, with reference to FIG. 5, the shield 422 can be pulled by the arm 452 attached to the motor 448 until the shield apertures 434 are no longer aligned with the sealing pads 424. The shield 422 is then repositioned to a covered position. In cases where the extendable probe is attached to a drill pipe, drilling operations such as a drilling direction or drilling speed can be altered based on a formation analysis using the measurements of formation fluids extracted by the formation tester tool. For example, a controller can perform a formation analysis to determine that a resistivity exceeds a resistivity threshold. In response, a drilling direction for a drilling operation can be altered. In other embodiments, actions such as changing a drilling mud density, stopping a drilling operation, or changing a drilling speed can be taken in response to a formation analysis based on the measurements of fluids extracted by the formation tester tool.

The flowchart 1000 is provided to aid in understanding the illustrations and is not to be used to limit scope of the claims. The flowchart includes example operations that can vary within the scope of the claims. Additional operations may be performed; fewer operations may be performed; the operations may be performed in parallel; and the operations may be performed in a different order. For example, operations in FIG. 10 can be performed for a plurality of shield apertures and extendable probes on a formation tester tool. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Example Computer

Figure 11:
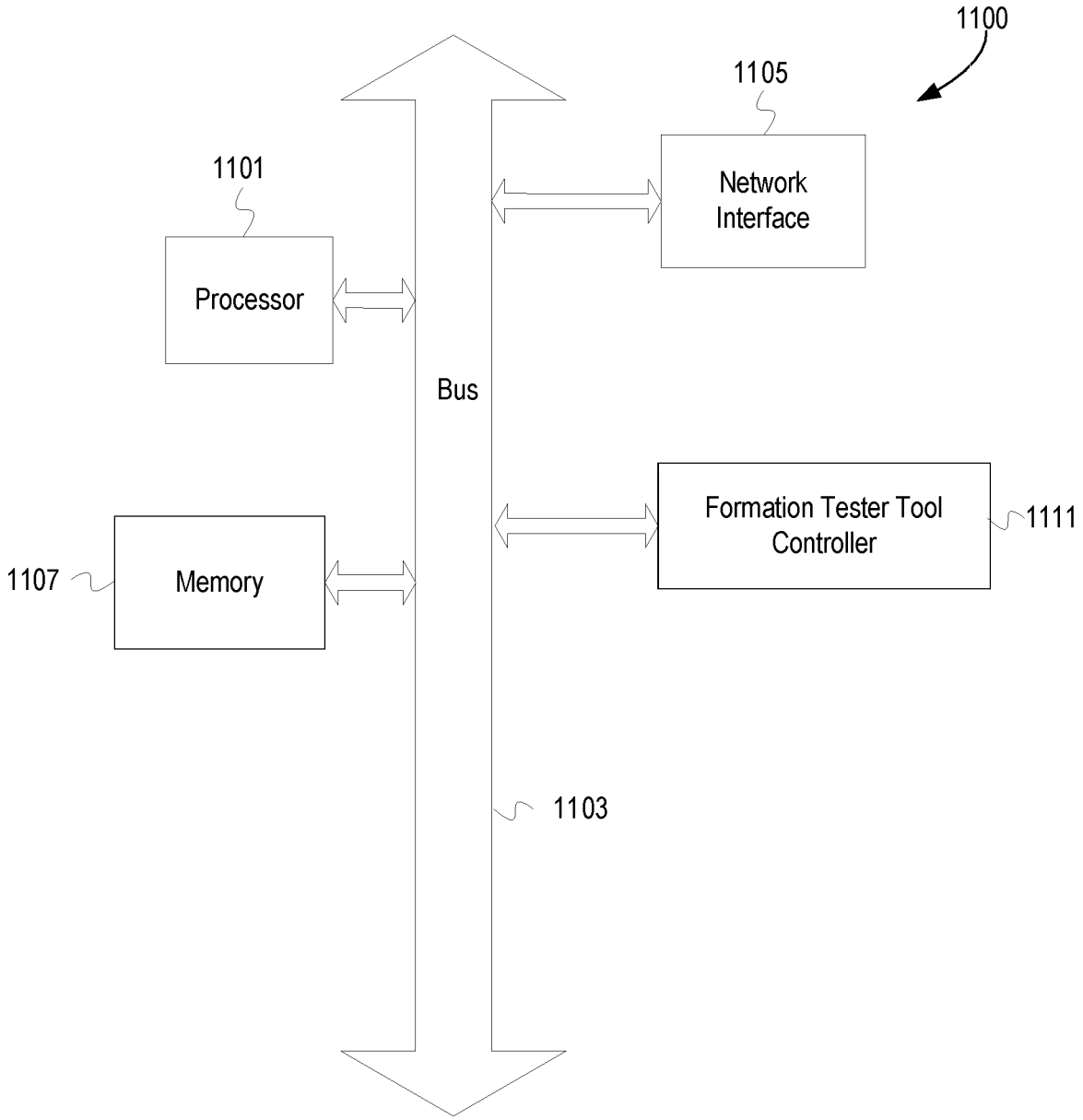
FIG. 11 is schematic diagram of an example computer device.

FIG. 11 is schematic diagram of an example computer device. A computer device 1100 includes a processor 1101 (possibly including multiple processors, multiple cores, multiple nodes, and/or implementing multi-threading, etc.). The computer device 1100 includes a memory 1107. The memory 1107 can be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer device 1100 also includes a bus 1103 (e.g., PCI, ISA, PCI-Express, HyperTransport® bus, InfiniBand® bus, NuBus, etc.) and a network interface 1105 (e.g., a Fiber Channel interface, an Ethernet interface, an internet small computer system interface, SONET interface, wireless interface, etc.).

The computer device 1100 includes a formation tester tool controller 1111. The formation tester tool controller 1111 can perform one or more operations described above. For example, the formation tester tool controller 1111 can move the shield longitudinally with respect to the formation tester tool. Additionally, the formation tester tool controller 1111 can move the sealing pad radially outward through the shield.

Any one of the previously described functionalities can be partially (or entirely) implemented in hardware and/or on the processor 1101. For example, the functionality can be implemented with an application specific integrated circuit, in logic implemented in the processor 1101, in a co-processor on a peripheral device or card, etc. Further, realizations can include fewer or additional components not illustrated in FIG. 11 (e.g., video cards, audio cards, additional network interfaces, peripheral devices, etc.). The processor 1101 and the network interface 1105 are coupled to the bus 1103. Although illustrated as being coupled to the bus 1103, the memory 1107 can be coupled to the processor 1101. The computer device 1100 can be a device at the surface and/or integrated into component(s) in the borehole. For example, with reference to FIG. 1, the computer device 1100 can be incorporated in the formation tester tool 110 and/or a computer at the surface.

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit" or "system." The functionality presented as individual units in the example illustrations can be organized differently in accordance with any one of platform (operating system and/or hardware), application ecosystem, interfaces, programmer preferences, programming language, administrator preferences, etc.

Any combination of one or more machine readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine-readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

Variations

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1: A formation tester tool comprising: an extendable probe having an extendable member configured to extend from a retracted position to an extended position such that an end of the extendable probe is in fluid communication with a wall of a borehole during an operation to capture a fluid from a formation; a sealing pad positioned circumferentially around the extendable probe, wherein a face of the sealing pad is configured to sealingly engage the wall of the borehole while the extendable member is in the extended position; and a shield to cover the sealing pad in a covered position between the sealing pad and the wall of the borehole.

Embodiment 2: The formation tester tool of Embodiment 1, wherein the sealing pad is positioned radially between a longitudinal axis of the formation tester tool and the shield.

Embodiment 3: The formation tester tool of Embodiments 1 or 2, wherein the shield is within a circumference of the formation tester tool in the covered position until the extendable member is in the extended position.

Embodiment 4: The formation tester tool of any of Embodiments 1-3, wherein at least a portion of the shield is configured to move from the covered position prior to the sealing pad engaging with the wall of the borehole.

Embodiment 5: The formation tester tool of any of Embodiments 1-4, wherein the portion of the shield is configured to be repositioned to the covered position after the extendable probe has moved from the extended position back to the retracted position.

Embodiment 6: The formation tester tool of any of Embodiments 1-5, wherein the portion of the shield is detached from the formation tester tool and unusable to cover the sealing pad after being moved from the covered position.

Embodiment 7: The formation tester tool of any of Embodiments 1-6, wherein the sealing pad is to engage the shield to detach the shield from the formation tester tool as part of extendable member moving from the retracted position to the extended position.

Embodiment 8: A method comprising: lowering a formation tester tool having an extendable probe into a borehole; determining whether the formation tester tool has reached a testing depth; and in response to determining that the formation tester tool has reached the testing depth, moving a shield from covering a sealing pad in a covered position, the sealing pad positioned circumferentially around an end of an extendable member of the extendable probe; and radially extending the extendable member of the extendable probe from a retracted position to an extended position until a face of the sealing pad is sealingly engaged with a wall of the borehole.

Embodiment 9: The method of Embodiment 8, further comprising: after radially extending the extendable probe, measuring, using the extendable probe, a fluid from a formation surrounding the wall of the borehole; and radially retracting the extendable probe back to the retracted position.

Embodiment 10: The method of Embodiments 8 or 9, further comprising: after measuring the fluid using the extendable probe, repositioning at least a portion of the shield to the covered position.

Embodiment 11: The method of any of Embodiments 8-10, further comprising performing a formation analysis based on the fluid.

Embodiment 12: The method of any of Embodiments 8-11, further comprising altering a drilling operation based on the formation analysis.

Embodiment 13: The method of any of Embodiments 8-12, wherein the formation tester tool is part of a bottomhole assembly of a drill string.

Embodiment 14: The method of any of Embodiments 8-13, wherein moving the shield covering the sealing pad in the covered position comprises: detaching the shield from the formation tester tool such that the shield is unusable to cover the sealing pad after being moved from the covered position.

Embodiment 15: The method of any of Embodiments 8-14, wherein a position of the shield prior to radially extending the extendable probe is within a circumference of the formation tester tool.

Embodiment 16: A drill string comprising: a drill bit to drill a borehole; and a bottomhole assembly attached to the drill bit, the bottomhole assembly having a formation tester tool that includes, an extendable probe having an extendable member configured to extend from a retracted position to an extended position such that an end of the extendable member is in fluid communication with a wall of the borehole during an operation to capture a fluid from a formation; a sealing pad positioned circumferentially around the extendable probe, wherein a face of the sealing pad is configured to sealingly engage the wall of the borehole while the extendable member is in the extended position; and a shield to cover the sealing pad in a covered position between the sealing pad and the wall of the borehole.

Embodiment 17: The drill string of Embodiment 16, wherein the sealing pad is positioned radially between a longitudinal axis of the formation tester tool and the shield.

Embodiment 18: The drill string of Embodiments 16 or 17, wherein the shield is within a circumference of the formation tester tool in the covered position until the extendable member is in the extended position.

Embodiment 19: The drill string of any of Embodiments 16-18, wherein at least a portion of the shield is configured to move from the covered position prior to the sealing pad engaging with the wall of the borehole.

Embodiment 20: The drill string of any of Embodiments 16-19, wherein the sealing pad is to engage the shield to detach the shield from the formation tester tool as part of extendable member moving from the retracted position to the extended position.

What is claimed is:

1. A formation tester tool comprising:

an extendable probe having an extendable member configured to extend from a retracted position to an extended position such that an end of the extendable probe is in fluid communication with a wall of a borehole during an operation to capture a fluid from a formation;

a sealing pad positioned circumferentially around the extendable probe, wherein a face of the sealing pad is configured to sealingly engage the wall of the borehole while the extendable member is in the extended position; and a shield to cover the sealing pad in a covered position between the sealing pad and the wall of the borehole, wherein the shield comprises an aperture, and wherein the shield is movable to align the aperture with the sealing pad to uncover the sealing pad.

2. The formation tester tool of claim 1, wherein the sealing pad is positioned radially between a longitudinal axis of the formation tester tool and the shield.

3. The formation tester tool of claim 1, wherein the shield is within a circumference of the formation tester tool in the covered position until the extendable member is in the extended position.

4. The formation tester tool of claim 1, wherein the shield is movable from the covered position to uncover the sealing pad, and wherein the shield is movable to return to the covered position after the extendable probe has moved from the extended position back to the retracted position.

5. The formation tester tool of claim 1, wherein the shield further comprises an aperture plate that covers the aperture, and wherein the sealing pad is to engage the aperture plate to detach the aperture plate from the shield as part of the extendable member moving from the retracted position to the extended position.

6. The formation tester tool of claim 1 further comprising beveled tracks, wherein the shield is movable along the beveled tracks to align the aperture with the sealing pad to uncover the sealing pad.

7. A method comprising:

lowering a formation tester tool having an extendable probe into a borehole;

determining whether the formation tester tool has reached a testing depth; and in response to determining that the formation tester tool has reached the testing depth, moving a shield from covering a sealing pad to align an aperture of the shield with the sealing pad, wherein the sealing pad is positioned circumferentially around an end of an extendable member of the extendable probe, and wherein alignment of the sealing pad and the aperture of the shield uncovers the sealing pad; and radially extending the extendable member of the extendable probe from a retracted position to an extended position until a face of the sealing pad is sealingly engaged with a wall of the borehole.

8. The method of claim 7, further comprising:

after radially extending the extendable probe, measuring, using the extendable probe, a fluid from a formation surrounding the wall of the borehole; and radially retracting the extendable probe back to the retracted position through the aperture.

9. The method of claim 8, further comprising:

after measuring the fluid using the extendable probe, repositioning at least a portion of the shield to cover the sealing pad.

10. The method of claim 9, further comprising performing a formation analysis based on the fluid.

11. The method of claim 10, further comprising altering a drilling operation based on the formation analysis.

12. The method of claim 7, wherein the formation tester tool is lowered into the borehole as part of a bottomhole assembly of a drill string.

13. The method of claim 7, wherein moving the shield from covering the sealing pad comprises:

detaching an aperture plate covering the aperture from the shield, where detaching the aperture plate removes the aperture plate from the shield.

14. The method of claim 7, wherein a position of the shield prior to radially extending the extendable probe is within a circumference of the formation tester tool.

15. A drill string comprising:

a drill bit to drill a borehole; and a bottomhole assembly attached to the drill bit, the bottomhole assembly having a formation tester tool that includes, an extendable probe having an extendable member configured to extend from a retracted position to an extended position such that an end of the extendable member is in fluid communication with a wall of the borehole during an operation to capture a fluid from a formation;

a sealing pad positioned circumferentially around the extendable probe, wherein a face of the sealing pad is configured to sealingly engage the wall of the borehole while the extendable member is in the extended position; and a shield to cover the sealing pad, wherein the shield comprises an aperture, and wherein the shield is movable to align the aperture with the sealing pad to expose the sealing pad to the wall of the borehole.

16. The drill string of claim 15, wherein the sealing pad is positioned radially between a longitudinal axis of the formation tester tool and the shield.

17. The drill string of claim 15, wherein the shield is within a circumference of the formation tester tool when covering the sealing pad until the extendable member is in the extended position.

18. The drill string of claim 15, wherein the shield further comprises an aperture plate that covers the aperture, and wherein the sealing pad is to engage the aperture plate to detach the aperture plate from the shield as part of the extendable member moving from the retracted position to the extended position.

* * * * *